United States Patent [19]

Scott-Jackson et al.

[11] 4,259,783

[45] Apr. 7, 1981

[54] BAR JOINTING

[75] Inventors: Dennis G. Scott-Jackson; Hui C. Lim, both of Burnaby, Canada

[73] Assignee: Windsor Machine Company Limited, Langley, Canada

[21] Appl. No.: 81,110

[22] Filed: Oct. 2, 1979

[30] Foreign Application Priority Data

Aug. 31, 1979 [CA] Canada ..... 334920

[51] Int. Cl.[3] ..... B27B 17/00

[52] U.S. Cl. ..... 30/384

[58] Field of Search ..... 30/383, 384, 385, 386, 30/387

[56] References Cited

U.S. PATENT DOCUMENTS

| | | | |
|---|---|---|---|
| 2,693,206 | 11/1954 | Anttonen | 30/384 X |
| 2,948,309 | 8/1960 | Hoff | 30/387 |
| 3,762,047 | 10/1973 | Scott-Jackson | 30/385 |
| 3,955,279 | 5/1976 | Pierson | 30/384 |
| 3,987,544 | 10/1976 | Gibson | 30/384 |
| 4,021,913 | 5/1977 | Arff | 30/384 |
| 4,060,895 | 12/1977 | Hille | 30/384 |

*Primary Examiner*—Jimmy C. Peters

*Attorney, Agent, or Firm*—Weldon F. Green

[57] ABSTRACT

In a segmented bar having a longitudinal axis, a first bar section slidably interengageable with a second bar section under longitudinal axially displacement to move into and out of end to end abutting interlocking mating relation, each of said bar sections presenting corresponding longitudinally extending mating surface formations on opposite sides and corresponding longitudinally extending mating edge formations along opposite edges, each bar section terminating in an abutting end edge formation to be presented to the abutting end edge formation of the other of said bar sections when disposed in interlocking mating relation, the opposed surface formations of one of said sections each including a locating recess therein and offset in relation to each other and each bounded by a portion of the extent of its adjacent abutting end edge formation, the opposed surface formations of the other of said sections each including a mating projection for each of said locating recesses and likewise offset in relation to each other and each bounded by a portion of the extent of its adjacent abutting end edge formation, said opposed locating recesses and projections being slidably interengageably in at least one longitudinal axially orientation thereof for longitudinal displacement of said bar sections into and out of end to end abutting interlocking mating relation. Said bar section when disposed in end to end abutting interlocking mating relation presents peripheral abutting end edge formations being offset longitudinally to one another.

45 Claims, 7 Drawing Figures

BAR JOINTING

FIELD OF INVENTION

This invention relates to improvements in bar jointing more particularly in the strengthening of the interconnection between releasably interlocked bar sections of elongated bars having a substantially greater length than width and especially to segmented saw bars used in chain saws to support and guide an endless loop of driven saw chain wherein the nose section of the saw bar is made releasably detachable from the main saw bar section for repair or replacement.

BACKGROUND OF THE INVENTION

Jointed or segmented bars can be utilized in a variety of circumstances in industry. It is desirable where jointing is undertaken to provide an arrangement which ensures full mating interengagement and is self-sustaining in interlocked relation, with registration, attachability and detachability of the respective sections readily accomplished and with the strength of the joint so established fully dependable within assigned limits of loading.

More particularly, the chain saw industry has adopted a jointed or segmented saw bar structure for a certain range of professional sizes and for certain range of domestic user sizes which segmented bar includes a main saw bar section and a replaceable rounded tip or nose section the nose section the nose section carrying a sprocket rotatably mounted therewithin on suitable bearings and being adapted to support and guide an endless saw chain as it is driven around the outermost curvate saw bar tip.

The adoption of the segmented saw bar has materially extended the useful life of the overall saw bar structure, in preserving the main saw bar section by allowing for repair or replacement of the rounded nose section which is normally subjected to greater loading abrasion and abuse.

Moreover, with the segmented saw bar the operator of the chain saw can readily detach and replace a damaged nose section in the field without any sophisticated tool or equipment.

A number of segmented or composite saw bar structures have been disclosed in prior published patents. As well several such structures have been manufactured and sold, some of which are reflected by those patents.

The following United States and Canadian patents illustrate a number of alternative proposals which will serve as background to those structures embodying the invention to be described and illustrated herein namely: U.S. Pat. Nos. 2,838,833, 2,888,964, 2,962,061, 3,124,177, 3,762,047 and 3,949,475. Canadian Pat. Nos. 506,987, 607,857, 696,847, 737,679 and 1,026,651.

The segmented saw or guide bar of the type under consideration can be derived from an elongated relatively heavy suitable steel bar or plate which is provided with a peripheral groove formation by a milling operation and subsequent heat treatment to provide a useable hardness.

It is common practice in the case of heavier saw bars which do not employ any sprocket or nose wheel to increase wear resistant of certain edges, particularly the edges of the rounded tip or nose section by applying a substance identified by the trade mark "Stellite" which increases resistance to wear and fatigue and consequent failure inflicted by frictional forces applied to such region particularly when the nose section is used for boring or plunge cutting.

The typical groove formation of a saw bar includes uniformly spaced apart rail formations arranged peripherally and outermost of the longitudinal and curvate edges of the tip or nose section, the dimensions of such groove formation being selected such that the bottom of the groove lies below the feet or tangs of centrally located drive links of the saw chain loop to be mounted upon the saw bar and so that the flanking rail formations support the tie straps or side links of such saw chain as it is driven in its endless path around the saw bar periphery.

Saw bars can also be fabricated from two-ply or three-ply laminates. The more common three-ply laminate is derived from three suitable steel bars or plates, the outer flanking plates typically having like dimensions and configuration and with the centrally located or sandwiched plate having a configuration corresponding to the flanking plates but of reduced dimensions so that when assembled and laminated the composite bar presents the aforementioned peripherally extending pair of rail formations outermost.

The rail formations of laminated bars particularly those portions bounding the tip or nose section being subjected to the same excessive wear and abuse likewise were usually protected by applying "Stellite" or other suitable material.

The introduction of direct drive chain saws lead to greatly increased wear and deterioration of saw bars. Solutions proposed included the adoption of the roller nose and the sprocket nose.

By modifying saw bars whether solid or laminated to provide a rotatable nose wheel or sprocket mounted upon bearings adjacent the nose end of such saw bar the saw chain could be carried around the nose out of close contact with the rail formation surfaces and so decrease frictional contact and wear.

An early example of a nose section carrying a sprocket is illustrated and described in U.S. Pat. No. 2,316,997.

Saw bar structures have been reduced in size, and the operating charcteristics of roller nose and sprocket nose bar have improved. However, the introduction of smaller chain did not lead to the adoption of smaller saw bar structures; rather it was the advent of smaller and lighter power heads that dictated the bar size and consequential chain pitch reduction. Yet the size reductions did not improve the operating characteristics of the roller and sprocket nose. These improvements were made by adjustments in design and processes brought about by failure analyses.

Notwithstanding such improved performance and increased life expectancy it was still desirable if not necessary to provide a segmented saw bar structure wherein the nose sections or assemblies could be readily replaced if damaged leading to the development of better jointing structures, for example, that revealed by U.S. Pat. No. 3,762,047 originating with the inventor named herein.

The segmented saw bar disclosed and claimed in U.S. Pat. No. 3,762,047 utilizes a main saw bar section presenting a bifurcated abutting end edge formation to the nose section and is adapted to receive mating spaced projections carried by the nose section the latter being provided with suitable reinforcing spacers therebetween to achieve a precise interfitting relationship when fully registered.

The bifurcations of the main saw bar section of U.S. Pat. No. 3,762,047 when subjected to requisite heat treatment or flame hardening tend to undergo dimensional changes in that region which afterwards must be corrected by grinding.

Moreover, with such arrangement it has been observed when the nose section is used for prying or is twisted the forces in shear applied to the bifurcations tended to cause early fatigue and failure.

Further, as will be observed the segmented saw bar of U.S. Pat. No. 3,762,047 includes abutting end edge formations which extend transversely of the longitudinal axis thereof and particularly in the region of abutment of the composite rail formations end edges lie in a common transverse plane.

An endless loop of saw chains on being driven against such rail discontinuity tends to have a standing wave imparted to it generating reactive forces which give rise to severe wear patterns in the bar periphery thereby shortening the useful life of such bar structure.

The Objects of the Invention

The principal object of this invention is to provide a bar joint for elongated bars and especially segmented saw bars of substantially increased strength and performance as compared with those earlier disclosed. More particularly, it is an object of the invention to provide improved structure in the adjoining regions of the bar sections normally subject to excessive wear and intermittent overloading and fatigue whereby the character of the wear and fatigue patterns are altered and the loading applied to the bar sections redistributed so as to substantially enhance the useful life of the respective bar sections.

Still another important object is to provide interengaging structures in bar jointing that minimizes dimensional changes of consequence in the requisite heat treatment steps so that corrections to bar dimensioning can be readily achieved through common expedients and without resort to extensive grinding operations.

Another very important object is to provide in the case of segmented saw bars a composite rail formation which tends to minimize generation of any standing wave pattern in the driven saw chain and so alleviate special damage attributable to reaction of the chain phenomenon.

It is still another object to provide a segmented saw bar of greater overall strength and utility and without sacrifice of any attribute of those saw bars currently available in the market place.

Features of the Invention

One feature of this invention resides in maximizing the loading capability of the segmented bar of the type aforementioned in the region of interlocking interengagement wherein the bar sections have reduced cross-sectional areas available for resisting deformation by providing in opposied surfaces of one mating bar section opposed locating recesses for mating with opposed mating projections of the other bar section and in offset relation to one another which has the effect of more widely distributing the loads to be applied and particularly tends to increase resistance to deformation in the region of interlocking interengagement under forces generated by twisting of the segmented bar, or in the case of a segmented saw bar when the nose section is used for prying.

More particularly, it is a feature to provide in opposed longitudinally extending mating surfaces of one bar section of a segmented bar, a shallow locating recess offset in relation to the other opposed locating recess with each recess bounded by an extended margin constituting a portion of the abutting end edge formation of such bar section with the opposed mating surface formations of the other bar section presenting spaced apart mating projections likewise offset and likewise bounded by an extended margin constituting a portion of its abutting end edge formation, the location and extent of the respective recesses and projections and their marginal edges effectively redistributing applied loads over an extended region of their respective sections and more remotely from the central region which has proved most advantageous and which in part distinguishes this proposal from all structures revealed by the patents earlier identified.

It will be understood that by such offset arrangement and the provision of extended boundaries for the mating locating recesses and projections the applied loads are distributed over substantially extended areas exemplified by the outlines of the boundaries of the respective recesses and projections which are not coterminous and tracing out opposing non-intersecting paths.

Another feature of this ivention resides in further enhancing resistance of bar sections to deformation by fully extending the offset recesses laterally to merge with a portion of one of its longitudinally edge formations which increases the transversely directed component of those forces resisting deformation of such bar section and thereby increases the loading capability of such arrangement.

Still another feature of the invention resides in providing offset locating recesses and mating projections which overlap centrally of their respective surface formations not only further extending the margins of the opposed locating recesses and mating projections and therefore further extending the distribution of applied forces over wider regions as earlier explained but additionally provides a small centrally located area of superimposed overlap useful for securing the mating sections together through provision of minimal apertures arranged in a pattern within such overlapping region and aligned to extend therethrough from one longitudinally extending mating surface formation to the other which apertures are adapted to receive suitable anchoring rivets.

Still another important feature resides in providing a configuration of locating recesses and mating projections in which, in a preferred embodiment, each bear the relationship of 180° inverse symmetry to the other, thereby not only enabling workmen to establish full registration in either of two axial orientations of the mating sections but such selection makes it possible to derive at least four of the bar components from only two dies, when the three-ply laminate structure is adopted; that is to say in a case of a segmented saw bar the flanking plate, components of the main saw bar section can be identical but laminated saw-bar-defining relation have 180° inverse symmetry; and in the case of the nose section likewise the flanking plate components housing the sprocket formation can be identical but in nose-section-defining relation have 180° inverse symmetry.

Thus, two dies are required for the production of four components of a preferred laminate assembly.

Still more particularly it is a feature to so contour the bounding edges of the offset recess and the mating projections to provide longitudinally extending surfaces of sliding abutment whereby respective bar sections are firmly held in axial orientation and supported and guided throughout longitudinal displacement.

Still another feature resides in providing a segmented saw bar having the features aforementioned and in which the bounding or peripheral edges of the mating sections, each include a centrally located groove therewithin when fully interengaged to define a pair of uniformly spaced apart rail formations therearound the margins of the locating recesses and mating projections including opposed portions of the spaced apart rail formations outermost therealong so that the abutting end edge portions of the rail formations along each edge are offset longitudinally to one another. This arrangement counters the tendency of a standing wave pattern to be generated in the driven saw chain and therefore minimizes damage normally experienced with such equipment.

DESCRIPTION OF THE INVENTION

These and other objects and features will become apparent in the following descriptions to be read in conjunction with the accompanying sheets of drawings in which, FIG. 1 is a side elevational view of one embodiment of a segmented saw bar structure made in accordance with this invention;

Figure 2:
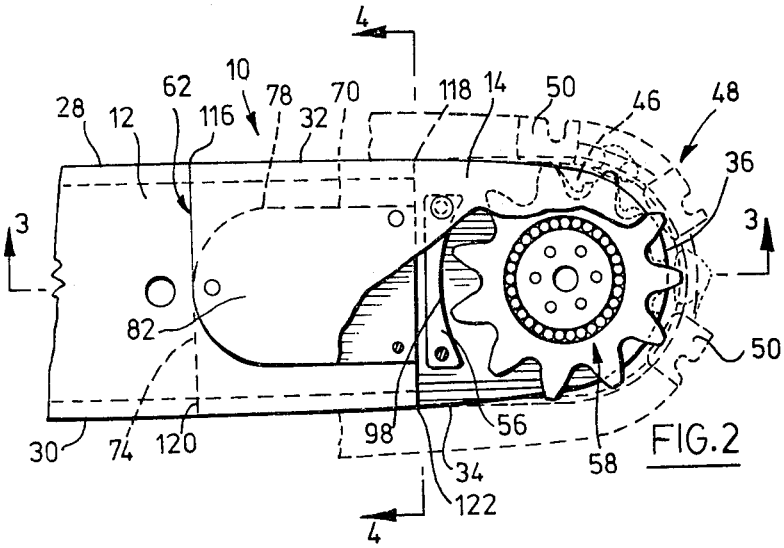
FIG. 2 is an enlarged side elevational view of the main saw bar section of FIG. 1 broken away and shown in mating relation with the tip or nose section, with part of the nose section also broken away to reveal internal structural characteristics.
Figure 4:
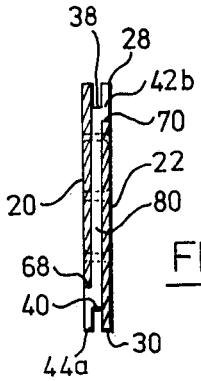
FIG. 4 is a cross-sectional view of the same mated saw bar sections of FIG. 2 but taken perpendicularly to the cross-section of FIG. 3 and along the lines 4—4 of FIG. 2.
Figure 3:
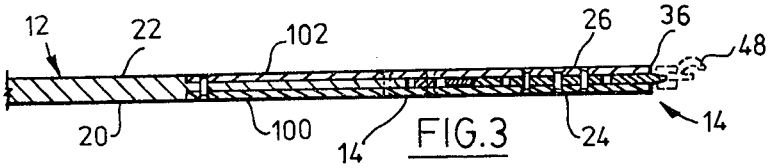
FIG. 3 is a cross-sectional view of the mated saw bar sections illustrated in FIG. 2 taken along the lines 3—3 of FIG. 2.
Figure 5:
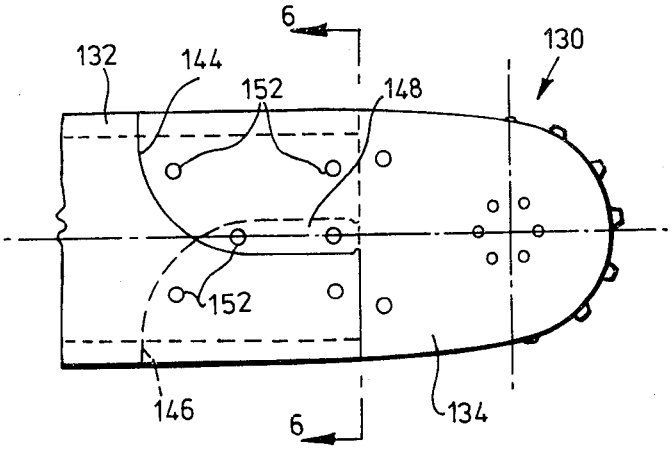
FIG. 5 is a side elevational view similar to that of FIGS. 1 and 2 but slightly modified and embodying the invention, with a portion of the main saw bar section broken away.
Figure 6:
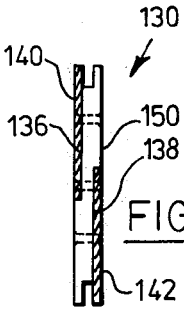
Figure 7:
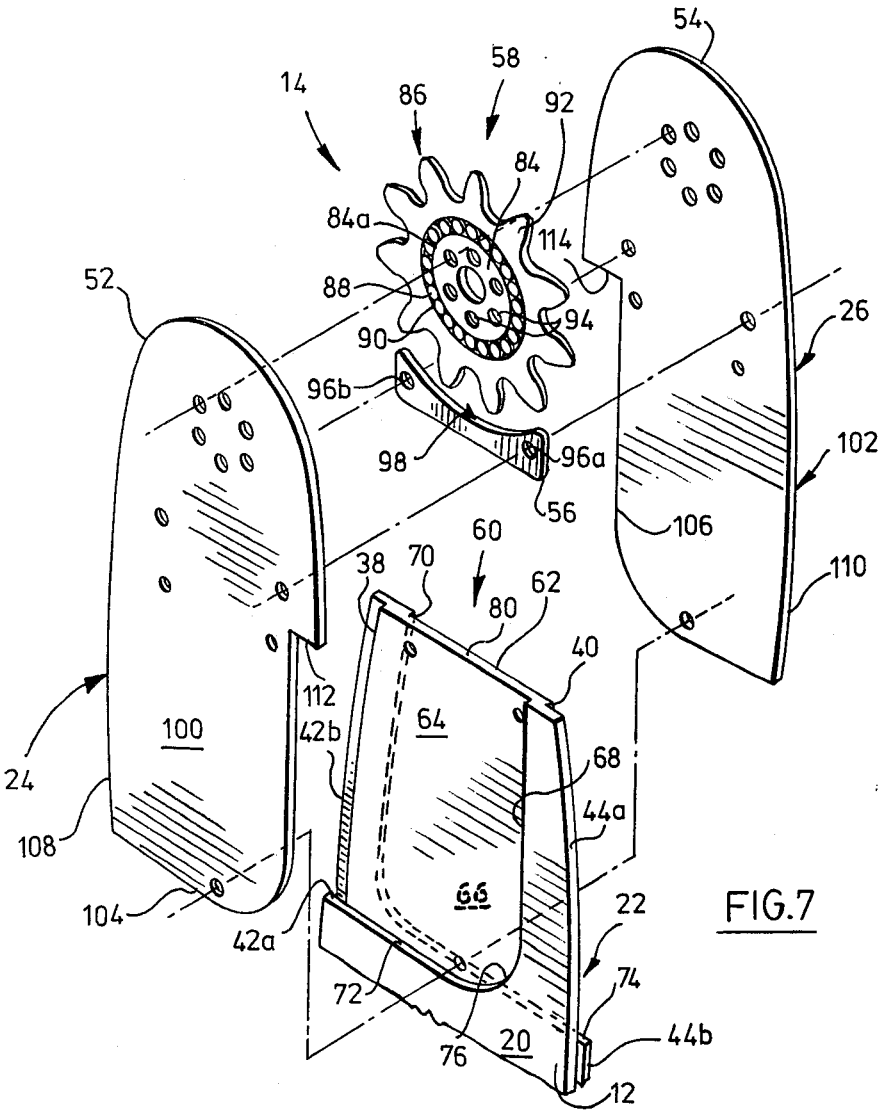

FIG. 6 is a cross-sectional view of the mated saw bar sections of FIG. 5 taken along the lines 6—6 of FIG. 5; and FIG. 7 is an exploded perspective view of those components of the segmented saw bar structure illustrated in FIG. 2 to reveal the precise outline in certain relationships of the components one to the other and particularly the outline of the offset locating recesses and locating projections presented by the respective mating saw bar sections.

Figure 1:
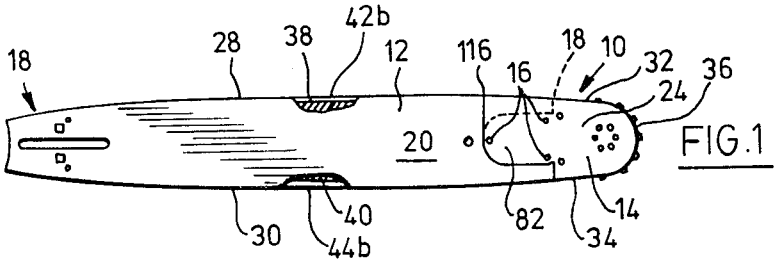

The elongated bar structure indicated at 10 in FIG. 1 takes the form of a saw or guide bar and includes a main saw bar section 12 with detachable rounded tip or nose section 14 releaseably secured thereto by a pattern of aligned apertures 16 three in number located centrally of the respective mating components for the reception of suitable anchoring rivets or other like fasteners of sufficient strength to hold the bar sections 12 and 14 against separation in use.

Main saw bar section 12 is adapted to be secured at the end thereof remote from mating nose section 14 to a suitable frame or support presented by the motor mounting for the chain saw, not illustrated, by means of a pattern of openings indicated generally at 18, which together with associated threaded posts and clamping devices, not illustrated, provide for secure attachment of such saw bar to the motor mounting all in a well known manner.

Chain saw bar sections 12 and 14 present opposed longitudinally extending substantially parallel mating surface formations 20, 22, 24 and 26 respectively on opposite sides, which surface formations are bounded by opposed longitudinally extending mating edge formations 28, 30, 32 and 34 respectively along opposite edges.

Nose section 14 is provided in the region remote from main saw bar section 12 with a curvate edge formation 36 of selected radius (or radii) in accordance with size and selected pitches of saw chain to be used with such saw bar.

Edge formations 28, 30, 32, 34 and 36 respectively present a centrally located groove formation or recess therealong opening outwardly and at a depth so as to present, in case of main saw bar section 12, longitudinal extending bottom walls 38, 40 respectively of uniform width flanked by uniformly separated upstanding longitudinally extending rail formations 42*a*, 42*b*, 44*a*, 44*b* respectively.

The depth of bottom walls 38, 40 of groove formations 28, 30 respectively are selected to lie slightly therebelow and give clear passage to drive links 46 of a saw chain loop indicated, partly, in broken outline at 48 in FIG. 2, with rail formations 42, 44 being sufficiently uniformly spaced apart to firmly support opposed tie straps or side links 50 of driven saw chain loop 48 as indicated in broken outline in FIG. 2.

The longitudinally extending surface formations 24, 26 of mating nose section 14 and the edge formations 32, 34, 36 are constituted by a pair of uniformly spaced apart plates identified as best seen in FIG. 7 at 52, 54 respectively. Plates 52, 54 are secured against separation by rivets and held in uniformly spaced apart relation by an intervening spacer plate 56 and a sprocket assembly 58 with the spacer plate 56 and sprocket assembly 58 by their respective uniform thicknesses establishing uniform separation of the edges of plates 52, 54 peripherally therearound corresponding to the separation of rail formations 42*a*, 42*b*, 44*a*, 44*b* whereby with bar sections 12 and 14 disposed in end to end abutting interlocking mating relation drive links 46 and the side links 50 of the saw chain loop 48 are readily accommodated and supported respectively by the edges constituting recesses edge formations 32, 34 and 36.

Main saw bar section 12 terminates at its outer end in transversely extending abutting end edge formation 60 as best seen in FIG. 7.

Composite nose bar section 14 likewise terminates at its inner end remote from its rounded edge formation 36 in a transversely extending abutting end edge formation 62 as best seen in FIGS. 1 and 2.

Longitudinally extending opposed mating surface formations 20, 22 of main saw bar section 12 are each provided with locating recesses 64, 66 therein respectively each bounded longitudinally inwardly by longitudinally extending margins or edge portions 68, 70 respectively and by transversely extending margins or edge portions 72, 74 respectively which edge portions are merged by bridging curvate margins or edge portions 76, 78 respectively intermediately thereof.

Locating recesses 64, 66 extend respectively partly along transversely extending edge formation 80 on opposite sides and in opposite directions and merge with adjacent portions of the respective longitudinally extending edge formations 28, 30 respectively and have a uniform depth throughout their extent so as to expose opposed rail formations 42*b* and 44*a* along a portion of the aforementioned opposed edge formations 28, 30.

Hence it will be observed that locating recesses 64, 66 open laterally to opposed edge formations 28, 30 respectively and longitudinally to and along part of end edge formation 80 and that marginal edges 68, 72, 76 of locating recess 64 and marginal edges 70, 74, 78 of locating recess 66 together with edge formation 80 constitute the mating abutting end edge formation 60 presented by main saw bar section 12.

Moreover, having regard to FIGS. 1 to 4 inclusive it will be observed that locating recesses 64, 66 are uniformly offset and of like perimetral extent in the preferred embodiment having 180° inverse symmetry, that is if main saw bar section 12 of FIG. 7 were rotated 180° about its longitudinal axis locating recess 66 would have precisely the same appearance and dimensioning as revealed by locating recess 64.

It also will be understood that in the preferred embodiment of the invention illustrated in FIGS. 1 to 4 inclusive and 7 not only are the locating recesses exemplified by 64 and 66 respectively offset in relation to each other and in relation to their longitudinal axis but that they overlap centrally as at 82 of their respective longitudinally extending mating opposed surface formations 20, 22.

It is desirable to provide such overlapping in order to extend and therefore maximize available cross-sectional area of bar section 12 for resistance to deformation by forces generated by twisting or prying. Such areas can be notionally represented by the extent and direction taken by the respective marginal edge portions 68, 72, 76 of locating recess 64 and marginal edge portions 70, 74, 78 of locating recess 66.

Such an arrangement provides a substantial improvement in the redistribution of loads when applied to the composite bar as compared with earlier arrangements.

According to the invention as it is embodied in a segmented saw bar mating section 14 takes the form of a tip or nose assembly as earlier described including spacer plate or insert 56 and a sprocket assembly 58.

Sprocket assembly 58 includes a central spacing element 84 presenting a peripheral bearing race 84*a* and outer sprocket component 86 mounted upon suitable roller bearings 88. Sprocket 86 component presents innermost the complementary outer race 90 to inner race 84*a* and outermost is provided with uniformly spaced teeth 92 of selected configuration to accommodate the pitch of saw chain 48 to be supported upon such teeth 92.

Central spacer member 84 is secured by a pattern of registering apertures and rivets as at 94 to the respective overlying side plates 52, 54, with sprocket component 86 being dimensioned for sliding rotation therebetween upon the roller bearings 88 all in a well known manner.

Spacer member 56 is anchored by registering apertures 96*a* and 96*b* and requisite anchoring rivets whose marginal edge 98 disposed towards sprocket assembly 58 is curvate to establish a part annular channel or tunnel to promote sweeping out of any debris that would tend to collect between plates 52, 54 during operation of the chain saw.

Spacer member 56 having a uniform thickness corresponding to central spacing element 84 likewise secures plates 52, 54 in uniformly spaced apart relation but terminates inwardly of peripheral edge formations 32, 34 to accommodate the passage of drive links 46 of the saw chain 48 along the supporting opposed edge formation 30 and 32 thereof.

Side plates 52, 54 have a perimetral configuration which is identical but when arranged in opposed nose-section-defining relation and secured together have 180° inverse symmetry.

The longitudinally extending opposed surface formations 24, 26 presented by plates 52, 54 on opposed sides include offset projection portions 100, 102 bounded by inner perimetral margins or edge portions 104 and 106 respectively and by longitudinally extending edge portions 108, 110 respectively with plates 52, 54 presenting adjacent transversely extending offset edge portions 112, 114 respectively, the marginal contours of the respective offset projection portions 100, 102 match or mate with the perimetral extent of the respective locating recesses 64, 66 of main saw bar section 12 as indicated in FIGS. 1 and 2 with the inner margins or edge portions 104, 106 together with edge portions 112, 114 constituting the abutting end edge formation 62 of nose bar section 14. The longitudinally extending edge portions 108 and 110 respectively serve in mating relation as part of the mating longitudinally extending edge formations 28, 30, 32 and 34 for supporting driven saw chain 48 in sliding engagement therealong.

Moreover, because of the 180° inverse symmetry of respective locating recesses 64, 66 and the projection portions 100, 102 it will be understood that interengagement longitudinally axially of nose section 14 with main saw bar section 12 may be readily accomplished in either one of two axial orientations.

It will be apparent from further examination of the saw bar sections 12 and 14 in FIGS. 2 and 7 particularly, that the juncture 116, 118 of the mating longitudinally extending edge formations 28, 32, are offset longitudinally as are the junctures 120, 122 of edge formations 30, 34.

When nose section 14 is moved into full end to end abutting registration with main saw bar section 12 as earlier described in projection portions 100, 102 mate with locating recesses 62, 64, and transversely extending edge 80 abuts edges 112, 114 so that a very strong interlock is achieved.

Particularly, by having the junctures 116, 118 and 120, 122 offset, standing wave patterns that would normally be generated in the saw chain are minimized, thereby minimizing liklihood of serious damage to the saw bar edges from reactive forces generated by such standing waves.

It is to be understood from the descriptions and drawings that the segmented saw bar structure of FIGS. 1 to 4 inclusive and FIG. 7 when subjected to twisting or prying forces, particularly in the region of the jointing will generate forces in shear applied by inner edge formations 104 and 106 respectively of projection portions 102, 104 respectively against the central web of main saw bar section 12 along the lines of abutment defined by composite marginal edge formations 68, 72, 76 of locating recess 64 and edges 70, 74, 78 of locating recess 66 respectively which forces are not only substantially redistributed by reason of the offset relationship of the boundaries but through an extended direction transversely of same transverse components are increased which aid in resisting deformation under loading and thereby substantially reducing likelihood of fatigue and failure occurring in the jointing area.

Further by providing the overlap as outlined, the lateral extent of projection portions 102, 104 can be substantially increased thereby by providing extended cross-sectional areas a substantial increase in resistance to deformation under conditions of loading can be expected.

Modified saw bar 130 revealed by FIGS. 5 and 6 includes main saw bar section 132 and mating nose section 134, likewise provided with locating recesses 136, 138 in offset relation in main saw bar section and corresponding mating projection portions 140, 142 of the nose section 134.

The contour of bounding edge formations indicated at 144 and at 146 in broken outline of respective projection portions 140, 142 correspond to the edge portions of matching locating recesses 136, 138 respectively but of a reduced lateral or transverse extent as compared with the structure revealed by FIGS. 1 to 4 inclusive and FIG. 7.

By narrowing the region of overlap as indicated at 148 in FIG. 5 the cross-sectional area of the main saw bar section in the region of the jointing is increased as may be seen in FIG. 6 where the end edge of main saw bar section 132 is illustrated at 150.

Reduction in the overlap however decreases the cross-section of the mating projection portions 140, 142 weakening the joint and as well a modified pattern of aligned openings and rivets must be adopted as indicated in FIG. 5 at 152 to secure the mating sections 132, 134 together.

Further it is to be understood that advantages accrue without any central overlap of the sections where loading of the jointed area is not critical namely the saving effect achieved by the offset junctures of the peripheral groove formations as earlier explained.

Hence a balance can be struck in the selection of those features of the invention that meet requirements of saw bars to be used for particular operations.

It is also to be understood from the drawings and the descriptions that main saw bar section 12 and 132 respectively of the two embodiments can be derived either from a suitable bar of steel or fabricated as a laminate. If the latter method is chosen then as in the case of the nose section 12 the configuration of the sides of main saw bar sections 12 and 132 are of 180° inverse symmetry; that is if the saw bar sections 12 and 132 of FIGS. 1 and 5 were rotated about its longitudinal axes 180° saw bars 12 and 132 would have precisely the same appearance as that illustrated, therefore, where the main saw bar section would comprise three steel bars, the outer flanking bars can be struck from the same die with the central bar having the outline following the outermost perimetral contour of the main bar sections 12 and 132.

All saw bar components are derived from suitable steel plates or bars or other alloyed materials and will be machined subjected to heat treatments and other processes to achieve useable hardness and durability in the field all in a manner well understood and practised.

While the preferred embodiments of the invention have been illustrated and described persons skilled in this field may make alterations or modifications therein without the departing from the spirit and scope of the appended claims.

What I claim is:

1. In a segmented bar having a longitudinal axis, a first bar section slidably interengageable with a second bar section under longitudinal axial displacement to move into and out of end to end abutting interlocking mating relation, each of said bar sections presenting corresponding longitudinally extending mating surface formations on opposite sides and corresponding longitudinally extending mating edge formations along opposite edges, each bar section terminating in an abutting end edge formation to be presented to the abutting end edge formation of the other of said bar sections when disposed in interlocking mating relation, the opposed surface formations of one of said sections each including a locating recess therein and offset in relation to each other and each bounded by a portion of the extent of its adjacent abutting end edge formation, the opposed surface formations of the other of said sections each including a mating projection for each of said locating recesses and likewise offset in relation to each other and each bounded by a portion of the extent of its adjacent abutting end edge formation, said opposed locating recesses and projections being slidably interengageable in at least one longitudinal axial orientation thereof for longitudinal displacement of said bar sections into and out of end to end abutting interlocking mating relation.

2. A segmented bar according to claim 1 in which said opposed offset locating recesses extend laterally in opposite directions respectively to each merge with a portion of one of its said mating longitudinally extending edge formations and said opposed offset mating projections likewise extend laterally to merge with one of its said mating longitudinally extending formations to thereby present substantially uninterrupted longitudinally extending mating edge formations with said respective bar sections fully registered in end to end abutting interlocking mating relation.

3. A segmented bar according to claim 1 in which said opposed offset locating recesses and mating projections overlap centrally of their respective opposed mating surface formations.

4. A segmented bar according to claims 1, 2 or 3 in which said opposed offset locating recesses and mating projections are slidably interengageable in two longitudinal axial orientations thereof.

5. A segmented bar according to claims 1, 2 or 3 in which certain abutting edge portions of said opposed offset locating recesses and mating projections are bounded in part by longitudinally extending surfaces of sliding abutment to thereby support and guide said respective bar sections in longitudinal axial orientation substantially throughout displacement of same into and out of end to end abutting interlocking mating relation.

6. A segmented bar according to claims 1, 2 or 3 in which means are provided for releasably securing said bar section against separation when disposed in end to end abutting interlocking mating relation.

7. A segmented bar according to claims 1, 2 or 3 in which said locating recesses and mating projections have a pattern of apertures therethrough adapted to register when said bar sections are disposed in end to end abutting interlocking mating relation for the reception of fasteners for releaseably securing same against separation.

8. In a segmented bar having a longitudinal axis, a first bar section slidably interengageable with a second bar section under longitudinal axial displacement to move into and out of end to end abutting interlocking mating relation, each of said bar sections presenting mating longitudinally extending surface formations on opposite sides thereof and mating longitudinally extending edge formations along opposite edges thereof, each bar section terminating in an abutting end edge formation to be presented to the abutting end edge formation of the other of said bar sections when disposed in interlocking mating relation, the opposed surface formations of one of said sections each including a locating recess therein offset in relation to the other locating recess, each locating recess opening both longitudinally and laterally from adjacent portions of its said abutting end edge formation and to an opposed one of said mating longitudinally extending edge formations respectively and with said opposed offset locating recesses overlapping centrally of their respective surface formations, the opposed surface formations of the other of said section each including a mating projection for each locating recess offset in relation to each other and likewise overlapping centrally of its said opposed surface formations with each mating projection likewise bounded both longitudinally and laterally by adjacent portions of its said abutting end edge formation and an opposed one of said longitudinally extending mating edge formations said opposed offset locating recesses and mating projections being slidably interengageable in at least one longitudinal axial orientation thereof for longitudinal displacement of said bar sections into and out of end to end abutting interlocking mating relation.

9. A segmented bar according to claim 8 in which said opposed longitudinally extending mating edge formations each include a longitudinally extending groove formation therewithin presenting substantially uniform spaced apart rail formations outermost therealong with the portions of the abutting end edge formations presented by said spaced apart rail formations being longitudinally offset in relation to one another.

10. A segmented bar according to claim 9 in which said opposed offset locating recesses and mating projections are bounded in part by longitudinally extending surfaces of sliding abutment innermost from the longitudinally extending mating edge formations of said respective bar sections to thereby support and guide said bar sections in longitudinal axial orientation substantially throughout displacement of same into and out of end to end abutting mating interlocking relation.

11. A segmented bar according to claims 8, 9 or 10 in which said opposed offset locating recesses and mating projections are slidably interengageable in two longitudinal axial orientations thereof.

12. A segmented bar according to claims 8, 9 or 10 in which means are provided for releaseably securing said bar sections against separation when disposed in end to end abutting interlocking mating relation.

13. A segmented bar according to claims 8, 9 or 10 in which said locating recesses and mating projections have a pattern of apertures therethrough adapted to register when said bar sections are disposed in end to end abutting interlocking mating relation for the reception of fasteners for releaseably securing same against separation.

14. In a segmented saw bar having a longitudinal axis a first main bar section slidably interengageable with a second nose bar section under longitudinal axial displacement to move into and out of end to end abutting interlocking mating relation, each of said saw bar sections presenting mating longitudinally extending surface formations on opposite sides and mating longitudinally extending edge formations along opposite edges, each bar section terminating in an abutting end edge formation to be presented to the abutting end edge formation of the other of said bar sections when disposed in interlocking mating relation, said nose bar section presenting a curvate edge formation of selected curvature along the end thereof remote from its said abutting end edge formation which curvate edge formation merges respectively uniformly with its longitudinally extending opposed edge formations, the mating surface formations of said bar section each including a shallow locating recess therein and offset in relation to the other said locating recess and each bounded by and merging with adjacent portions of its abutting end edge formation and an opposed one of its said mating longitudinally extending edge formations, and opening both longitudinally and laterally respectively therealong, the mating surface formations of said nose bar section each including a mating projection for each locating recess likewise offset in relation to each other and each bounded by adjacent portions of its abutting end edge formation and an opposed one of its longitudinally extending mating edge formations, said locating recesses and mating projections being slidably interengageable in at least one longitudinal axial orientation thereof for longitudinal displacement into and out of abutting interlocking mating relation, said opposed longitudinally extending mating edge formations and curvate edge formation respectively each including a centrally located groove formation therewithin presenting substantially uniformly spaced apart rail formations outermost therealong, whereby said bar sections when disposed in end to end abutting interlocking mating relation present a composite pair of rail formations extending therearound, with the portions of said abutting end edge formations presented by said pair of rail formations being offset longitudinally to one another.

15. A segmented saw bar according to claim 14 in which said opposed offset locating recesses and mating projections are arranged in overlapping spaced apart relation centrally of their respective mating surface formations.

16. A segmented saw bar according to claim 14 in which said opposed offset locating recesses and mating projections are slidably interengageable in two longitudinal axial orientations thereof.

17. A segmented saw bar according to claims 14, 15 or 16 in which said opposed offset locating recesses and mating projections are bounded in part by longitudinally extending surfaces of sliding abutment innermost from said longitudinally extending mating edge formations to thereby support and guide said bar sections in longitudinal axial orientation substantially throughout displacement of same into and out of end to end abutting mating interlocking relation.

18. A segmented saw bar according to claims 14, 15 or 16 in which means are provided for releasably securing said saw bar sections against separation when disposed in end to end abutting interlocking mating relation.

19. A segmented saw bar according to claims 14, 15 or 16 in which said locating recesses and mating projections each have a pattern of apertures therethrough adapted to register when said saw bar sections are disposed in end to end abutting interlocking mating relation for the reception of suitable fasteners for releasably securing same against separation.

20. A segmented saw bar according to claims 14, 15 or 16 in which said main saw bar section is comprised of a laminate of three plates, the centrally located laminate having a substantially uniform thickness throughout its extent and said flanking laminates each including a perimetral recess defining a portion of the bounding edge of one of said opposed offset locating recesses.

21. A segmented saw bar according to claims 14, 15 or 16 in which said main bar section is comprised of a laminate of three plates, the centrally located laminate having a substantially uniform thickness throughout its extent and said flanking laminates of like perimetral extent and including a perimetral recess defining a bounding edge portion of one of said opposed offset locating recesses, the flanking laminates having 180° inverse symmetry.

22. A segmented bar according to claims 14, 15 or 16 in which said nose section includes a pair of plates of like perimetral extent arranged in overlying spaced apart registrations such that one said plate has 180° inverse symmetry in relation to the other with means extending between said plates and inwardly of their respective perimeters for securing same against separation.

23. A segmented saw bar according to claim 14 in which said nose section includes a pair of plates of like perimetral extent arranged in overlying spaced apart registration such that they exhibit 180° inverse symmetry, with means extending between said plates for securing same against separation, said securing means including bearing means for supporting a rotatable sprocket means therebetween, whereby a saw chain can be supported and guided in relation to said nose section in its passage therearound.

24. A segmented saw bar according to claim 14 in which said nose section includes plates of like perimetral extent means for securing said plate and overlying substantially uniform spaced apart registration, such that said plates exhibits 180° inverse symmetry, said securing means including spacer means arranged to extend laterally between said plates in a region remote from said curvate edge formation and bearing means sufficiently longitudinally displaced from said spacer means toward said curvate edge formation whereby sprocket means may be rotatably supported thereupon whereby a saw chain can be supported and guided in its relation to said nose section in its passage therearound.

25. A segmented saw bar according to claims 23 or 24 wherein said bearing means includes an inner race fixedly secured to said overlying plates, sprocket means present an outer surrounding race in uniformly spaced relation to said aforementioned inner race, and bearing means extending between said respective races for rotatably supporting said sprocket means.

26. A segmented saw bar according to claims 14, 15, 16, 23 or 24 in which abutting end edge formation of said main saw bar section includes an abutting portion extending at substantially right angles to the longitudinal axis of same and from one of said opposed mating longitudinal edge formations to the other.

27. A segmented saw bar according to claim 24 in which said spacer means presents a curvate edge portion to said bearing means to define therewith a part annular channel therethrough, said nose section for passing a rotatably mounted sprocket means therethrough.

28. A segmented bar according to claim 4 in which certain abutting edge portions of said opposed offset locating recesses and mating projections are bounded in part by longitudinally extending surfaces of sliding abutment to thereby support and guide said respective bar sections in longitudinal axial orientation substantially throughout displacement of same into and out of end to end abutting interlocking mating relation.

29. A segmented bar according to claim 4 in which means are provided for releasably securing said bar section against separation when disposed in end to end abutting interlocking mating relation.

30. A segmented bar according to claim 4 in which said locating recesses and mating projections have a pattern of apertures therethrough adapted to register when said bar sections are disposed in end to end abutting interlocking mating relation for the reception of fasteners for releasably securing same against separation.

31. A segmented bar according to claim 5 in which means are provided for releasably securing said bar section against separation when disposed in end to end abutting interlocking mating relation.

32. A segmented bar according to claim 28 in which means are provided for releasably securing said bar section against separation when disposed in end to end abutting interlocking mating relation.

33. A segmented bar according to claim 5 in which said locating recesses and mating projections have a pattern of apertures therethrough adapted to register when said bar sections are disposed in end to end abutting interlocking mating relation for the reception of fasteners for releasably securing same against separation.

34. A segmented bar according to claim 28 in which said locating recesses and mating projections have a pattern of apertures therethrough adapted to register when said bar sections are disposed in end to end abutting interlocking mating relation for the reception of fasteners for releasably securing same against separation.

35. A segmented bar according to claim 6 in which said locating recesses and mating projections have a pattern of apertures therethrough adapted to register when said bar sections are disposed in end to end abutting interlocking mating relation for the reception of fasteners for releasably securing same against separation.

36. A segmented bar according to claim 29 in which said locating recesses and mating projections have a pattern of apertures therethrough adapted to register when said bar sections are disposed in end to end abutting interlocking mating relation for the reception of fasteners for releasably securing same against separation.

37. A segmented bar according to claim 31 in which said locating recesses and mating projections have a pattern of apertures therethrough adapted to register when said bar sections are disposed in end to end abutting interlocking mating relation for the reception of fasteners for releasably securing same against separation.

38. A segmented bar according to claim 32 in which said locating recesses and mating projections have a pattern of apertures therethrough adapted to register when said bar sections are disposed in end to end abutting interlocking mating relation for the reception of fasteners for releasably securing same against separation.

39. A segmented saw bar according to claim 15 in which said opposed offset locating recesses and mating projections are slidably interengageable in two longitudinal axial orientations thereof.

40. A segmented saw bar according to claim 39 in which said opposed offset locating recesses and mating projections are bounded in part by longitudinally extending surfaces of sliding abutment innermost from said longitudinally extending mating edge formations to thereby support and guide said bar sections in longitudinal axial orientation substantially throughout displacement of same into and out of end to end abutting mating interlocking relation.

41. A segmented saw bar according to claim 39 in which means are provided for releasably securing said saw bar sections against separation when disposed in end to end abutting interlocking mating relation.

42. A segmented saw according to claim 39 in which said locating recesses and mating projections each have a pattern of apertures therethrough adapted to register when said saw bar sections are disposed in end to end abutting interlocking mating relation for the reception of suitable fasteners for releasably securing same against separation.

43. A segmented saw bar according to claim 39 in which said main saw bar section is comprised of a laminate of three plates, the centrally located laminate having a substantially uniform thickness throughout its extent and said flanking laminates each including a perimetral recess defining a portion of the bounding edge of one of said opposed offset locating recesses.

44. A segmented saw bar according to claim 39 in which said main bar section is comprised of a laminate of three plates, the centrally located laminate having a substantially uniform thickness throughout its extent and said flanking laminates of like perimetral extent and including a perimetral recess defining a bounding edge portion of one of said opposed offset locating recesses, the flanking laminates having 180° inverse symmetry.

45. A segmented bar according to claim 39 in which said nose section includes a pair of plates of like perimetral extent arranged in overlying spaced apart registrations such that one said plate has 180° inverse symmetry in relation to the other with means extending between said plates and inwardly of their respective perimeters for securing same against separation.

* * * * *